US008573662B2

(12) United States Patent
Thiel

(10) Patent No.: US 8,573,662 B2
(45) Date of Patent: Nov. 5, 2013

(54) MAGNETIC WORKPIECE HANDLING DEVICES

(75) Inventor: Walter Thiel, Schwaikheim (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 0 days.

(21) Appl. No.: 13/326,486

(22) Filed: Dec. 15, 2011

(65) Prior Publication Data

US 2012/0153649 A1 Jun. 21, 2012

(30) Foreign Application Priority Data

Dec. 17, 2010 (EP) ..... 10015772

(51) Int. Cl.
*B66C 1/04* (2006.01)

(52) U.S. Cl.
USPC ..... 294/65.5; 294/192; 294/907

(58) Field of Classification Search
USPC ..... 294/65.5, 192, 907; 901/40, 37
See application file for complete search history.

(56) References Cited

U.S. PATENT DOCUMENTS 6,015,175 A * 1/2000 Carruth et al. ..... 294/65.5
7,086,675 B2 * 8/2006 Jacobs ..... 294/2
7,963,578 B2 * 6/2011 Wells et al. ..... 294/2

FOREIGN PATENT DOCUMENTS

EP 2085349 A1 8/2009
WO WO 2005095254 A1 * 10/2005 ..... B66C 1/04

* cited by examiner

*Primary Examiner* — Saul Rodriguez
*Assistant Examiner* — Gabriela Puig
(74) *Attorney, Agent, or Firm* — Fish & Richardson P.C.

(57) ABSTRACT

In some aspects, a magnetic workpiece handling device includes a housing, a housing bottom having an end face, a magnetic piston, and a fluid connection for delivering a working fluid into the housing for moving the piston between an operating position and a rest position. The working fluid is delivered at at least first and second working pressures, the first working pressure transferring the piston into the operating position near the housing bottom and the second working pressure transferring the piston into the rest position away from the housing bottom. The handling device includes a detection device to detect the presence of a workpiece and to determine a pressure of the working fluid. The piston has a vertically movable holding magnet that faces the housing bottom for holding the workpiece. The holding magnet controls a valve arrangement of the detection device.

25 Claims, 5 Drawing Sheets

MAGNETIC WORKPIECE HANDLING DEVICES

CROSS REFERENCE TO RELATED APPLICATION

This application claims priority under 35 U.S.C. §119(a) to European Application No. 10 015 772.6, filed on Dec. 17, 2010, the entire contents of which are hereby incorporated by reference in their entirety.

TECHNICAL FIELD

The invention relates to magnetic workpiece handling devices.

BACKGROUND

EP 2 085 349 A1 discloses an example workpiece magnetic grab that includes a housing having a housing bottom that has an end face facing a workpiece to be grabbed. A magnetic piston that can be moved up and down is arranged in the housing. Disposed on the housing is a connection for a drive fluid for moving the magnetic piston so that the magnetic piston can be subjected to a first working pressure and transferred into an operating setting (i.e., an operating position). In the operating setting, the magnetic piston is positioned on or close to the housing bottom. Using a second working pressure, the magnetic piston can be transferred back into a rest setting (i.e., a rest position) into a movement chamber, in which the magnetic piston is positioned away from the housing bottom.

It can be advantageous for such magnetic grabs to automatically detect whether or not a workpiece has been picked up and whether the workpiece has been lost (e.g., dropped) during transport. Monitoring takes place via a detection device that is inserted separately into the magnetic piston and has a controllable valve having a separate permanent magnet which is guided so that it can be moved up and down in the magnetic piston, while the holding magnet is anchored in the magnetic piston.

SUMMARY

The combination of a holding magnet and a detection device in a magnetic piston allows for the simplification in the design and construction of a magnetic grab. Therefore, in some aspects, a magnetic workpiece handling device or magnetic grab includes a holding magnet arranged in the magnetic piston such that it can be moved up and down in the magnetic piston. The holding magnet functions as both a holding magnet and a detection magnet which opens and closes a valve arrangement in the detection device. As a result, when a workpiece is magnetized and grabbed by the magnetic grab, it is possible for the holding magnet to be in an active operating position and for a working pressure of a working fluid of the detection device to be maintained. In this operating position, the holding magnet simultaneously closes the valve arrangement of the detection device and acts as a detection magnet to control the detection device. As a result, the detection device detects whether a workpiece is present and gripped by the magnetic grab. If a workpiece is not grabbed by the magnetic grab, the holding magnet remains in an inactive operating position. As a result, the valve arrangement of the detection device remains open so that the working pressure drops and the detection device detects that there is no workpiece or a workpiece has not been gripped by the magnetic grab.

The magnetic piston, which can be moved up and down in the magnetic grab, typically has a recess that is open towards the housing bottom and in which the holding magnet is guided and can move up and down. As a result, the holding magnet is guided in a secured manner in the magnetic piston and can be moved independently of the magnetic piston to control the valve arrangement of the detection device depending on whether or not a workpiece is present.

Typically, the holding magnet is accommodated in a sliding guide in the magnetic piston so that the holding magnet can be transferred smoothly into at least one operating position. This sliding guide is typically configured as a cup-shaped lifting piston that is guided such that it can be moved up and down in the recess of the magnetic piston. Alternatively, a sliding guide can also be formed between the holding magnet and the recess of the magnetic piston.

In certain embodiments, in order to arrange the holding magnet in an inactive operating position (i.e., a starting position) with respect to the magnetic piston, an elastically resilient element (e.g., a spring element) is arranged to retain the holding magnet inside the recess. As a result, the holding magnet rests in the inactive operating position in which the valve arrangement is slightly open without the assistance of a vacuum force or a magnetic force.

In some embodiments, the magnetic grab includes a locking element to secure the elastically resilient element against the holding magnet, the sliding guide, or a contact surface of the recess. The locking element is secured to an end-side wall portion of the recess. This allows the elastically resilient element to be mounted and arranged in a simple manner. Similarly, the elastically resilient element can easily be replaced in the event of fatigue.

The restoring force of the elastically resilient element is typically greater than the weight force of the holding magnet and a valve-closing member of the valve arrangement or greater than the weight force of the holding magnet in the sliding guide and the valve-closing member of the valve arrangement. The restoring force of the elastically resilient element is also typically less than a magnetic force generated by the holding magnet when a workpiece is present. As a result, the inactive operating position of the holding magnet with respect to the magnetic piston can be set easily with a transfer of the holding magnet into an operating position being ensured at the same time. The magnetic force of the holding magnet, which typically extends, in terms of area, over at least half of the diameter of the magnetic piston, is much greater than the restoring force of the at least one elastically resilient element. Spring elements (e.g., spring washers, plate springs or other pressure elements) can be used as elastically resilient elements.

In some embodiments, a through-bore is provided as a valve opening in the floor of the recess of the magnetic piston. The through-bore is used for opening and closing a valve-closing member that typically acts based on the position and movement of the holding magnet. A valve seat of the valve opening is arranged in a conical manner and includes a sealing element, in which a valve-closing member having a cooperative fitting shape acts so that in the event of a lifting movement of the holding magnet from the inactive operating position into the active operating position, the valve-closing member is transferred into a closing position and the conical surfaces of the valve-closing member and the valve opening adjoin one another. As a result, the necessary closing force for controlling and sealing off the valve opening can be applied simultaneously via the holding magnet.

Furthermore, in the inactive operating position of the holding magnet in the recess of the magnetic piston, the valve-closing member is disposed in an opening position. Typically, the valve-closing member is secured in place via a setting mechanism, the height of which can be changed with respect to the holding magnet. Typically, a threaded screw is used so that the closing movement of the valve-closing member can be adapted easily in a corresponding manner to the maximum lift of the holding magnet in the recess.

The detection device, in some embodiments, has a passage that extends from the valve opening in the floor of the recess of the magnetic piston into at least one duct portion between the holding magnet or the sliding guide and the floor of the recess. The passage extends outward radially to a relief bore that extends through an outer wall of the recess. As a result, when a workpiece is not present, a vacuum that has built up in the magnetic grab to produce a lowering movement of the magnetic piston from the rest setting into the operating setting can be decreased. As long as the workpiece is not resting against the end face of the magnetic grab or is not in the immediate vicinity thereof, the holding magnet is typically not transferred from the rest setting into the operating setting, that is to say that the valve arrangement of the detection device is not closed. On account of this passage, which remains open when a workpiece is not present, the vacuum can be decreased via a through-bore in the magnetic grab, which is connected to the ambient air environment. A control unit of the detection device detects that a component is not present.

In some embodiments, an annular duct between the at least one duct portion and the at least one relief bore is formed in the floor of the recess. Thus, a small number of duct portions are sufficient to guide the air flowing in via the valve arrangement to the relief bore or to a plurality of relief bores via the annular duct. As a result, less manufacturing processing is typically required. In addition, assembly can be simplified since a particular installation direction has to be taken into account.

Furthermore, the at least one duct portion is typically formed as a trough-shaped cavity in the floor of the recess or in an outer side of the sliding guide or the holding magnet. Such a duct portion can be formed in the holding magnet when the magnetic grab does not include a sliding guide, which typically has a cup-shape and surrounds the holding magnet apart from the end side facing towards the housing bottom.

In some embodiments, for the transfer of the magnetic piston into the operating setting, a negative pressure (e.g., a vacuum) is applied as the working pressure so that the detection device maintains the applied working pressure during grabbing and handling of the workpiece. As a result, the magnetic grab can detect and monitor the presence of workpieces more easily using the working pressure. Certain conventional magnetic grabs can be modified to include similar detection and monitoring systems that use the working pressure to detect and monitor workpieces.

In some embodiments, for the transfer of the magnetic piston into the operating setting, a negative pressure (e.g., a vacuum) is applied as the working pressure, and the working pressure decreases while the workpiece is not present, being released, or deposited onto a working area. This is based on the fact that, on account of the resiliently elastic element, the holding magnet is returned into its inactive operating position and simultaneously the valve arrangement is opened. As a result, ambient air can flow in via a through-bore that leads into the movement chamber of the magnetic piston and can pass through the passage to the detection device.

Furthermore, the detection device typically has a sensor that detects at least one working pressure for transferring the magnetic piston into the operating setting. This configuration of the sensor makes it possible, when multiple magnetic grabs are provided for handling a workpiece, for each individual magnetic grab to be monitored by a sensor assigned thereto, with the sensors being disposed in a valve bank remote from the magnetic grab.

Some of the magnetic grabs described herein can be designed to have fewer components and to have a simpler construction for more efficient manufacturing and production than certain other magnetic grabs.

Additionally, the magnetic grabs described herein having detection devices integrated into the magnetic piston can be manufactured to be smaller in diameter than certain conventional magnetic grabs.

Aspects of the invention and also further advantageous embodiments and developments thereof are explained and described in more detail in the following text on the basis of the examples illustrated in the drawings. The features which can be gathered from the description and the drawings can be applied according to the invention individually per se or multiply in any desired combination.

DETAILED DESCRIPTION

Figure 1:
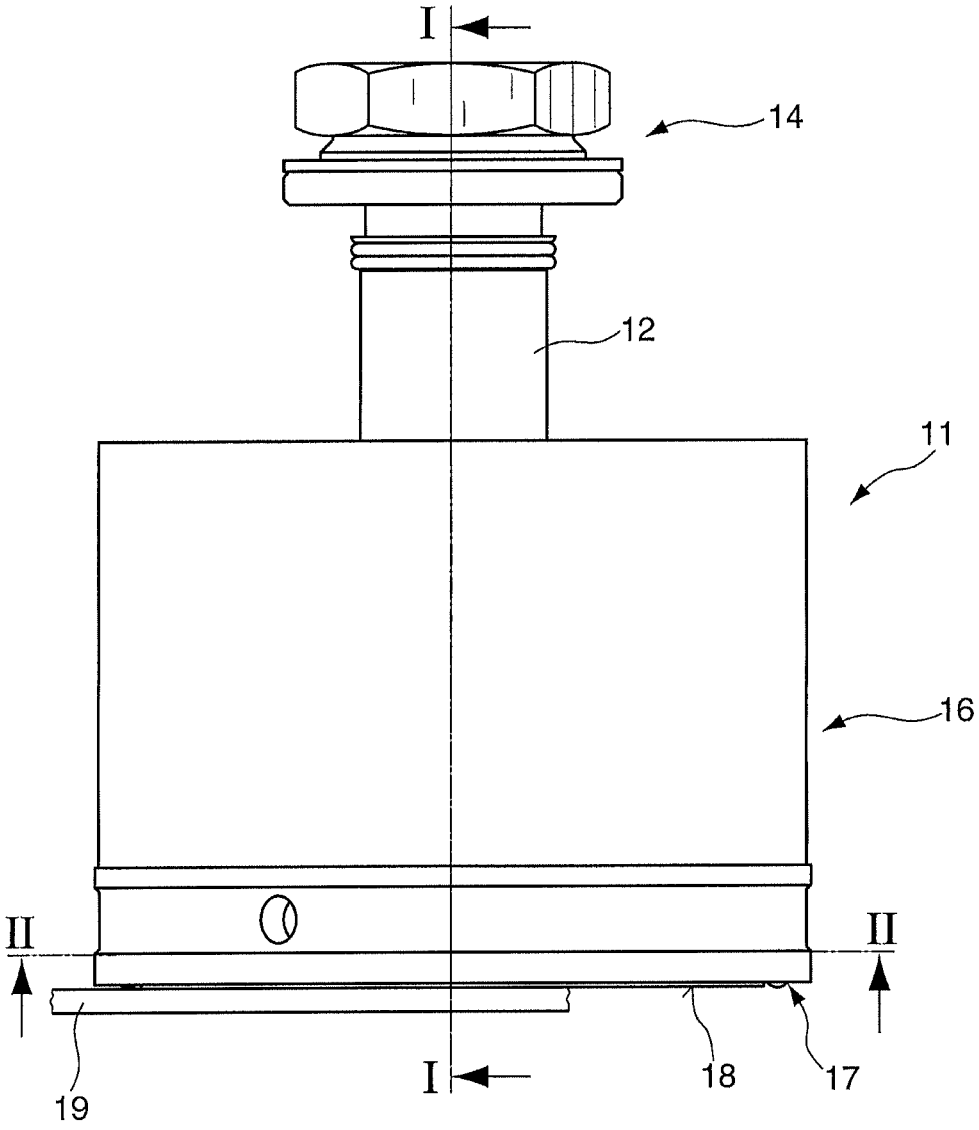
FIG. 1 is a schematic side view of a magnetic grab.

FIG. 1 shows a schematic side view of a magnetic workpiece holding device or magnetic grab 11, which has a neck 12 and, at an upper end, a fastening device 14 for fastening the magnetic grab 11, for example, to a robot arm or to a handling device. At an opposite, lower end, a housing bottom 17 is fastened (e.g., screwed) to a cup-shaped housing 16. The housing bottom 17 has an end face 18 that can be rested against a workpiece 19 (partially illustrated) to be grabbed or handled by the magnetic grab 11. The workpiece 19 is typically a ferromagnetic (e.g., steel) plate.

Figure 2:
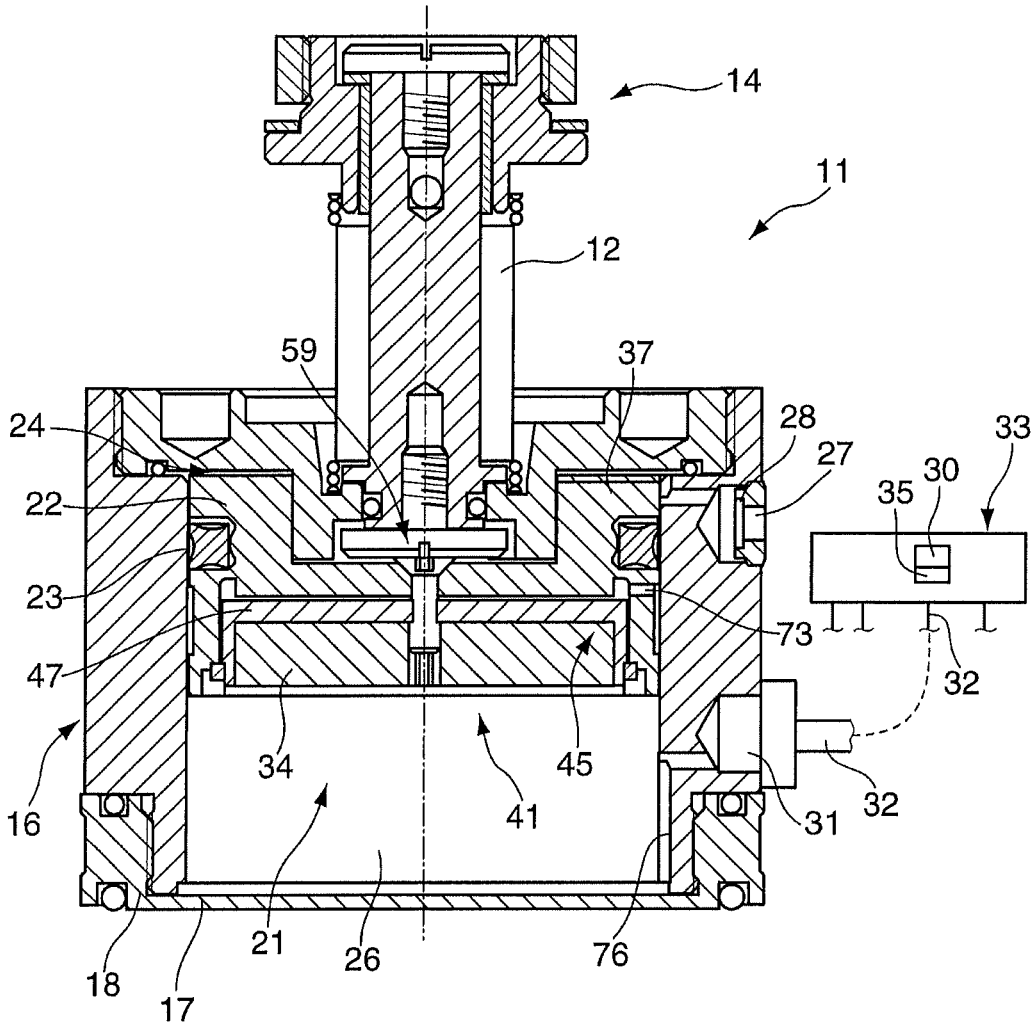
FIG. 2 is a schematic cross-sectional view of the magnetic grab of FIG. 1 along the line I-I in FIG. 1, with a magnetic piston in a rest setting.

FIG. 2 is a sectional view of the magnetic grab 11 along the line I-I in FIG. 1. In the housing 16, a magnetic piston 21 is guided to move up and down in a movement chamber 24. The magnetic piston 21 in FIG. 2 is shown in a rest setting or rest position 37, that is to say that the magnetic piston 21 is held in an upper position.

The magnetic piston 21 includes a guide ring 22 having a seal 23 that separates a movement chamber 24 above the magnetic piston 21 from a piston chamber 26 between the magnetic piston and the housing bottom 17. The size of the two chambers 24, 26 is determined by the position of the magnetic piston 21 in the housing 16. The movement chamber 24 is open to the ambient air environment via a through-bore 27. The through-bore 27 can include a screen 28 (e.g., a filter) in order to protect the movement chamber from contamination. The piston chamber 26 is connected to a connection (e.g., a pneumatic connection) 31 to which a pressure line 32 is connected. The pressure line 32 is connected to a pneumatic valve bank having multiple control valves 30. Via the valve bank 33, multiple pressure lines 32 are actuated by control valves 30, with each pressure line 32 typically being assigned one sensor 35, which monitors the working pressure in the pressure line 32. The signals detected by the sensor 35 are sent to a control unit (e.g., a microprocessor) for evaluation and also for controlling the magnetic grab 11.

Figure 3:
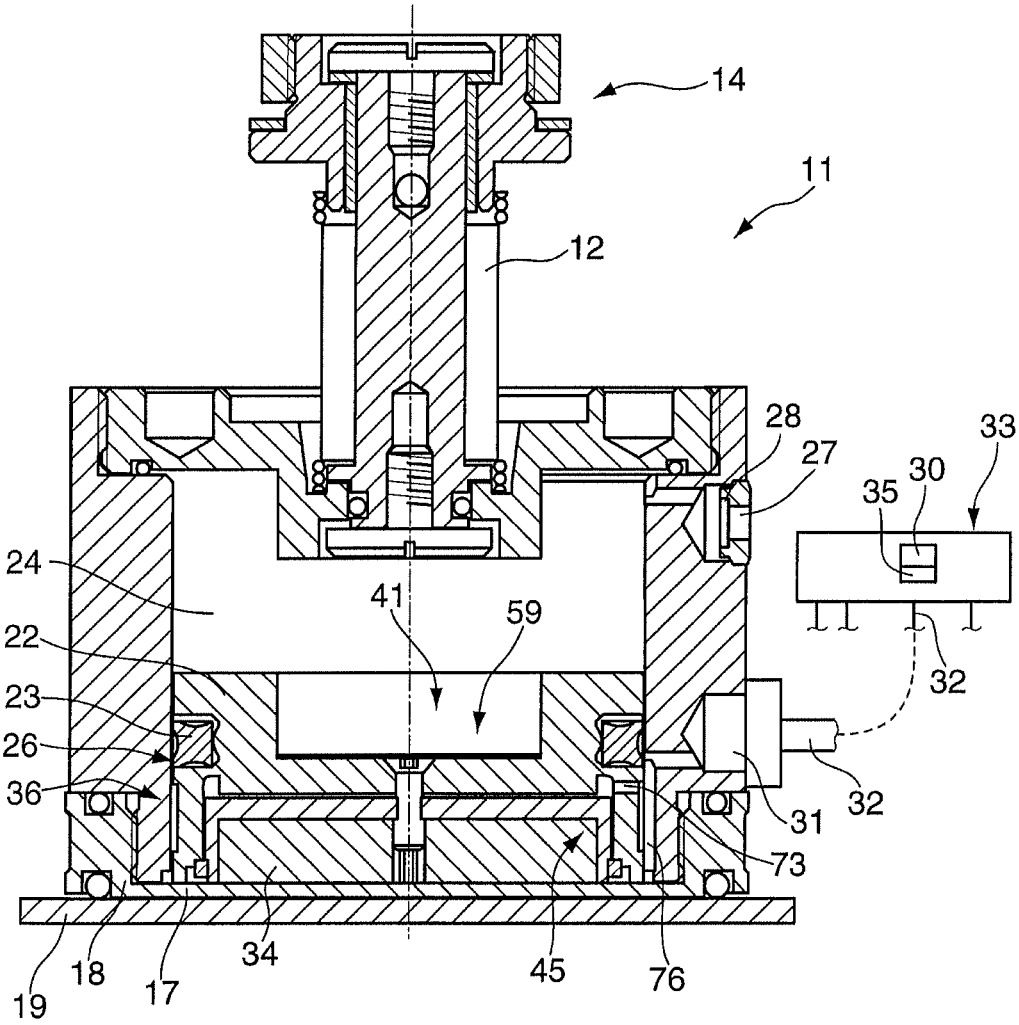
FIG. 3 is a schematic cross-sectional view of the magnetic grab of FIG. 1 along the line I-I in FIG. 1, with a magnetic piston in an operating setting.

In order to move the magnetic piston 21 from the rest setting 37 (shown in FIG. 2) into an operating setting or operating position 36 (shown in FIG. 3), a working pressure (e.g., a negative pressure or a vacuum) is applied to the piston chamber 26 via the connection 31. The magnetic piston 21 is sealed from the movement chamber 24 via the seal 23 so that the piston chamber 26, which is connected to the pressure line 32, forms a virtually closed fluid chamber. Although the valve arrangement 59 of the detection device 41, which is coupled to the holding magnet 34, remains open, this opening or gap, which has a small cross section, does not significantly impair the lifting movement of the magnetic piston.

Figure 4A:
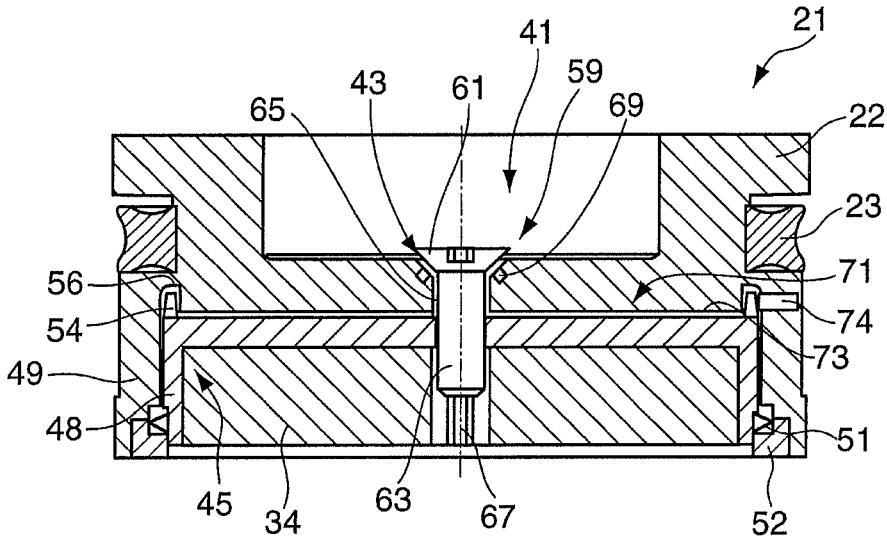
FIG. 4*a* is an enlarged schematic view of the magnetic piston of the magnetic grab of FIG. 3 in an inactive operating position.
Figure 4B:
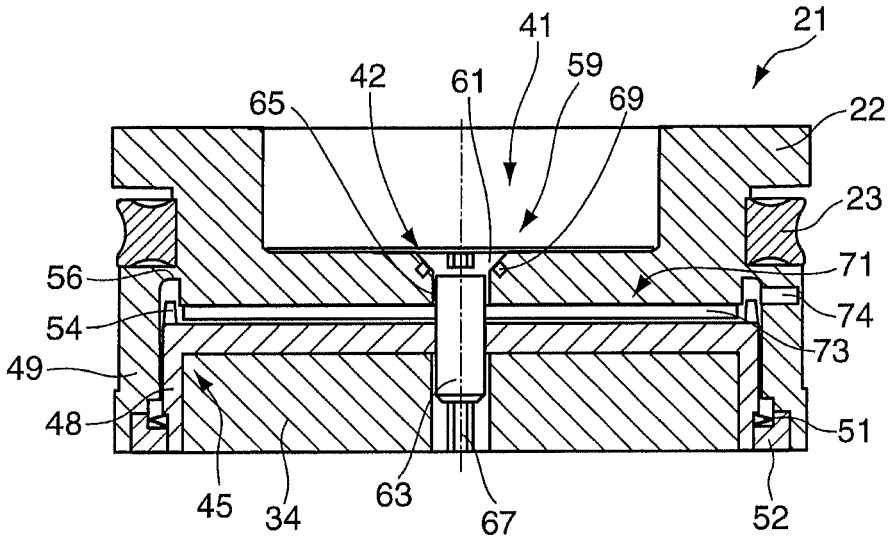
FIG. 4*b* is an enlarged schematic view of the magnetic piston of the magnetic grab of FIG. 3 in an active operating position.

On account of the applied working pressure, the magnetic piston 21 is transferred into a lower position. On account of the magnetization of the workpiece 19, a magnetic holding force acts between the holding magnet 34 and the ferromagnetic workpiece 19. As a result, the holding magnet 34 is transferred from an inactive working position 43 (shown in FIG. 4*a*) into an active working position (shown in FIG. 4*b*) that results in the valve arrangement 59 closing. The workpiece 19 is held against the housing bottom 17 only by this magnetic holding force. In the operating setting, a further working pressure (e.g., ambient pressure) is applied to the top of the magnetic piston 21 in the movement chamber. In order to deposit or otherwise release the workpiece 19, the vacuum applied to the piston chamber 26 is decreased or pressure pulses are introduced into the piston chamber 26. As a result, the holding magnet 34 is pushed back into the inactive operating position 43 (shown in FIG. 4*a*) and the valve arrangement 59 is opened, and the magnetic piston 21 is pushed into a raised position with respect to the housing bottom 17 (i.e., into the rest setting 37 shown in FIG. 2). The movement of the magnetic piston 21 thus takes place in the piston chamber 26, that is to say that no large volume flows of compressed air or vacuum have to be made available.

The holding magnet 34 of the magnetic piston 21 serves to actuate the detection device 41 while simultaneously holding the workpiece 19 by magnetization. The functioning and interaction of the holding magnet 34 and the detection device 41 will now be explained with reference to FIGS. 4*a* and 4*b*, in which the magnetic piston 21 is illustrated in an enlarged manner. The magnetic piston 21 includes a recess 45 that is open towards the housing bottom 17. The holding magnet 34 is arranged in the recess 45 such that it can move up and down, that is to say that, within the recess 45, the holding magnet 34 can move along a stroke length from the inactive operating position 43 (shown in FIG. 4*a*) to the active position 42 (shown in FIG. 4*b*).

The holding magnet 34 is positioned in a sliding guide 47 that is formed in a cup-shaped manner and acts as a reciprocating piston. Alternatively, the holding magnet 34 can also be arranged directly in the recess 45 (e.g., without a sliding guide 47). This sliding guide 47 has a peripheral wall 48 that slides against an outer wall 49 of the recess 45 and is guided thereby in the axial direction. To arrange the holding magnet 34 in the inactive operating position 43, a resiliently elastic element 51 is arranged on top of a locking element 52 attached to the outer wall 49 and provides an upward force against the sliding guide 47, the peripheral wall 48, or the holding magnet 34. The locking element 52 is releaseably connected to the guide ring 22 (e.g., as an annular screw element). The resiliently elastic element 51 can include a compression spring or a plate spring. Similarly, resilient rubber elements can be used. In the recess 45, the sliding guide 47 has a collar 54 that engages at least partially in an annular duct 56 formed in the recess 45. The position of the holding magnet 34 in the recess 45 in the inactive operating position 43 can typically be determined by the height of the collar 54.

The detection device 41 includes the valve arrangement 59 having a valve-closing member 61, which has a holding portion 63 that passes through a valve opening 65 to engage in a bore 67 arranged along the longitudinal central axis of the sliding guide 47 and the holding magnet 34. Typically, the holding portion 63 is threaded, so that the valve-closing member 61 can be set at a desired distance from the holding magnet 34. Additionally, the closing position of the valve arrangement 59 can be adapted to the maximum desired stroke length of the holding magnet 34 from the active operating position 42 to the inactive operating position 43. The valve-closing member 61 typically has a conical top that acts on a conical valve seat. A seal 69 can also be provided in the valve seat.

A passage 71 is formed between the movement chamber 24 and the piston chamber 26, the passage 71 is open when the detection device 41 is inactive, that is to say when the holding magnet 34 is arranged in the inactive operating position and the valve-closing member 61 is lifted with respect to the valve opening 65. This passage 71 includes the valve opening 65 and also at least one adjoining duct portion 73, which extends radially outwards and merges into at least one relief bore 74, which opens into an annular chamber 76 (shown in FIGS. 2 and 3) that is connected to the pneumatic connection 31 and adjoins the piston chamber 26.

Figure 5:
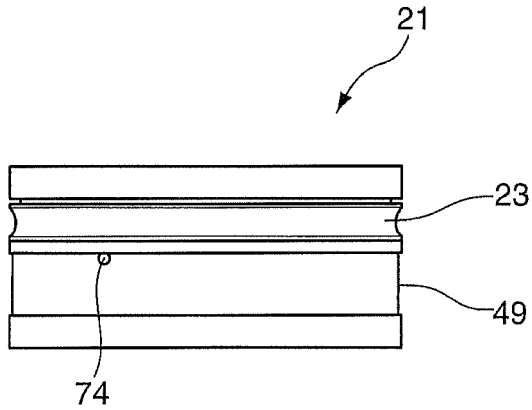
FIG. 5 is a schematic side view of the magnetic piston of FIG. 3.

FIG. 5 is a schematic side view from outside of the magnetic piston 21 with its outer wall 49 having at least one relief bore 74.

Figure 6:
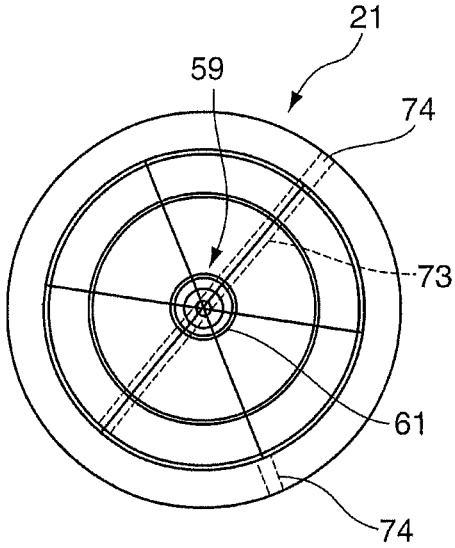
FIG. 6 is a schematic top view of the magnetic piston of FIG. 3.

FIG. 6 is a schematic top view of the magnetic piston 21, in which, by way of example, a duct portion 73 leading to the relief bore 74 is illustrated by dashed lines. The duct portion 73 can be incorporated into the floor of the recess 45 as a groove or trough to create a fluid connection between the valve opening 65 and the relief bore 74. The collar 54 on the sliding guide 47 is interrupted at individual points so that passages are formed to the annular duct 56, which is in turn connected to at least one relief bore 74.

In order to arrange the holding magnet 34 in the inactive operating position 43, a restoring force of the resiliently elastic element 51 is greater than the combined weight force of the holding magnet 34, the sliding guide 47, and the valve-closing member 61. If no sliding guide 47 is provided, the restoring force of the resiliently elastic element 51 is greater than the weight force of the holding magnet 34 and the valve-closing member 61.

The detection device 41 detects and monitors a workpiece 19 held by the magnetic grab 11 in the following manner. The magnetic grab 11 is positioned with respect to the workpiece 19 to be handled. At the same time, a low pressure (e.g., a vacuum) is applied in the piston chamber 26 so that the magnetic piston 21 is transferred from the rest setting 37 (shown in FIG. 2) to the operating setting 36 (shown in FIG. 4*a*). If a workpiece 19 is present below the magnetic grab 11 for magnetization, the sliding guide 47 and holding magnet 34 are transferred within the magnetic piston 21, on account of the acting magnet force, from the inactive operating position 43 (shown in FIG. 4*a*) into the active operating position 42 (shown in FIG. 4*b*). Once the sliding guide 47 and holding magnet 34 reach the active operating position 42, the valve arrangement 59 closes so that the passage 71 for pressure equalization is closed off and the vacuum is thus maintained. As a result, the control unit determines that the workpiece 19 has been grabbed and is present.

If the workpiece 19 is not grabbed, the sliding guide 47 and holding magnet 34 are not transferred from the inactive operating position 43 to the active operating position 42 and the valve arrangement 59 is not closed. In case the workpiece 19 is lost after it has been grabbed, the holding magnet 34 moves along a return stroke from the active operating position 42 to the inactive position 43 on account of the restoring force of the resiliently elastic element 51. When the sliding guide 47 and the holding magnet 34 are in the inactive position, the passage 71 is open so that air can flow in from the movement chamber 24 and thus pressure equalization can occur. On account of the pressure difference, the control unit detects that the workpiece 19 is no longer present or has not been grabbed.

On account of the lifting movement of the holding magnet 34 in the magnetic piston 21 and the resulting actuation of the valve arrangement 59 of the detection device 41, the magnetic grab 11 can be designed more simply in order to detect and hold ferromagnetic workpieces.

A number of embodiments have been described. Nevertheless, it will be understood that various modifications may be made without departing from the spirit and scope of the invention. Accordingly, other embodiments are within the scope of the following claims.

What is claimed is:

1. A magnetic workpiece handling device comprising:

a housing;

a housing bottom secured to the housing, the housing bottom having an end face facing a workpiece to be grabbed;

a magnetic piston disposed in the housing;

at least one fluid connection for delivering a working fluid into the housing for moving the magnetic piston between an operating position and a rest position, the working fluid being delivered at at least a first working pressure and a second working pressure, the first working pressure transferring the magnetic piston into the operating position in which the magnetic piston is positioned on or close to the housing bottom, and the second working pressure transferring the magnetic piston into the rest position in which the magnetic piston is positioned away from the housing bottom; and a detection device to detect the holding or the non-presence of the workpiece on the end face of the housing and to determine a pressure of the working fluid, wherein the magnetic piston has a holding magnet for holding the workpiece against the housing bottom, the holding magnet faces the housing bottom and is movable within the magnetic piston, and the holding magnet controls a valve arrangement of the detection device.

2. The magnetic workpiece handling device according to claim 1, wherein the magnetic piston defines a recess that is open towards the housing bottom and in which the holding magnet is vertically movable.

3. The magnetic workpiece handling device according to claim 2, wherein the holding magnet is arranged in a cup-shaped sliding guide that guides the holding magnet in the recess.

4. The magnetic workpiece handling device according to claim 2, wherein the holding magnet is held within the recess of the magnetic piston with an elastically resilient element in an inactive operating position.

5. The magnetic workpiece handling device according to claim 4, wherein in the inactive operating position, the holding magnet is spaced from an end of the magnetic piston.

6. The magnetic workpiece handling device according to claim 4, further comprising a locking element releasably connected to an outer wall of the piston, the locking element holding the elastically resilient element against the holding magnet.

7. The magnetic workpiece handling device according to claim 4, further comprising:

a cup-shaped sliding guide in which the holding magnet is arranged, the sliding guide guiding the holding magnet in the recess; and a locking element releasably connected to an outer wall of the magnetic piston, the locking element holding the elastically resilient element against the sliding guide.

8. The magnetic workpiece handling device according to claim 4, wherein a restoring force of the elastically resilient element is greater than the combined weight force of the holding magnet and a valve-closing member of the valve arrangement, and the restoring force is less than a magnetic force of the magnetic piston when the workpiece is present adjacent to the housing bottom.

9. The magnetic workpiece handling device according to claim 4, further comprising a cup-shaped sliding guide in which the holding magnet is arranged, the sliding guide guiding the holding magnet in the recess, wherein a restoring force of the elastically resilient element is greater than the combined weight force of the sliding guide, the holding magnet, and a valve-closing member of the valve arrangement and the restoring force is less than a magnetic force of the magnetic piston when the workpiece is present adjacent to the housing bottom.

10. The magnetic workpiece handling device according to claim 1, wherein the valve arrangement comprises:

a valve opening that is formed in a floor of a recess of the magnetic piston in which the holding magnet is arranged;

a valve seat; and a valve-closing member that extends through the valve opening and is secured to the holding magnet.

11. The magnetic workpiece handling device according to claim 10, wherein in a closed valve arrangement, the valve closing member contacts the valve seat to close the valve opening.

12. The magnetic workpiece handling device according to claim 10, wherein in an inactive operating position of the holding magnet, the valve-closing member is disposed in an open position.

13. The magnetic workpiece handling device according to claim 10, wherein the detection device comprises a passage that extends outward radially from the valve opening to at least one relief bore via at least one duct portion between the holding magnet and a floor of the recess, the at least one relief bore being formed though an outer wall of the recess of the magnetic piston.

14. The magnetic workpiece handling device according to claim 13, wherein an annular duct is formed on the floor of the recess of the magnetic piston between the at least one duct portion and the at least one relief bore.

15. The magnetic workpiece handling device according to claim 13, wherein the at least one duct portion is formed by a trough-shaped or groove-shaped cavity in the floor of the recess or by an outer side of the holding magnet that faces the floor of the recess.

16. The magnetic workpiece handling device according to claim 10, further comprising a sliding guide in which the holding magnet is arranged, the sliding guide guiding the holding magnet within the recess, wherein the detection device comprises a passage that extends outward radially from the valve opening to at least one relief bore via at least one duct portion between the sliding guide and a floor of the recess, the at least one relief bore being formed though an outer wall of the recess of the magnetic piston.

17. The magnetic workpiece handling device according to claim 16, wherein an annular duct is formed on the floor of the recess of the magnetic piston between the at least one duct portion and the at least one relief bore.

18. The magnetic workpiece handling device according to claim 16, wherein the at least one duct portion is formed by a trough-shaped or groove-shaped cavity in the floor of the recess, formed by an outer side of the sliding guide that faces the floor of the recess.

19. The magnetic workpiece handling device according to claim 1, wherein the first working pressure is applied to transfer the magnetic piston into the operating position, and during grabbing or handling of the workpiece, the detection device has a closed valve arrangement and the first working pressure is maintained, which indicates that the workpiece is being retained.

20. The magnetic workpiece handling device according to claim 1, wherein the first working pressure is applied to transfer the magnetic piston into the operating position, and when the workpiece is not present, a pressure of the working fluid decreases from the first working pressure as a result of an open valve arrangement of the detection device, which indicates that the workpiece is being released or deposited.

21. The magnetic workpiece handling device according to claim 1, further comprising at least one sensor to detect a difference in a pressure of the working fluid when the magnetic piston is moved from an inactive operating position to an active operating position.

22. The magnetic workpiece handling device according to claim 1, wherein the detection device comprises a sensor to detect the pressure of the working fluid.

23. The magnetic workpiece handling device according to claim 1, wherein the holding magnet is a single holding magnet.

24. The magnetic workpiece handling device according to claim 1, wherein the holding magnet is coaxial with a central axis of the magnetic piston.

25. The magnetic workpiece handling device according to claim 1, wherein the detection device is coaxial with a central axis of the magnetic piston.

* * * * *